US008080770B2

(12) United States Patent
Richardson et al.

(10) Patent No.: US 8,080,770 B2
(45) Date of Patent: Dec. 20, 2011

(54) MICROWAVABLE METALLIC CONTAINER

(75) Inventors: Michael Richardson, Superior, CO (US); Jason Kaanta, Pine, CO (US); Vincent Hirsch, Boulder, CO (US)

(73) Assignee: Ball Corporation, Broomfield, CO (US)

( * ) Notice: Subject to any disclaimer, the term of this patent is extended or adjusted under 35 U.S.C. 154(b) by 1175 days.

(21) Appl. No.: 11/743,578

(22) Filed: May 2, 2007

(65) Prior Publication Data

US 2007/0284368 A1 Dec. 13, 2007

Related U.S. Application Data

(63) Continuation-in-part of application No. 11/064,224, filed on Feb. 22, 2005, now Pat. No. 7,378,625, which is a continuation-in-part of application No. 10/797,749, filed on Mar. 9, 2004, now Pat. No. 7,112,771.

(51) Int. Cl.
*H05B 6/60* (2006.01)
*H05B 6/80* (2006.01)

(52) U.S. Cl. ..... 219/725; 219/728; 229/5.6

(58) Field of Classification Search ..... 219/725, 219/724, 728, 729, 730, 731, 732, 734, 736; 99/DIG. 14; 426/107, 241, 234, 243; 220/258.2, 220/359.1, 612, 258.5, 359.2, 212.5, 270, 220/276, 780, 574.1; 229/5.6
See application file for complete search history.

(56) References Cited

U.S. PATENT DOCUMENTS

| | | | |
|---|---|---|---|
| 2,714,070 | A | 7/1955 | Welch |
| 3,079,031 | A | 2/1963 | Henchert |
| 3,219,460 | A | 11/1965 | Brown |
| 3,379,358 | A | 4/1968 | Cvacho |
| 3,547,305 | A | 12/1970 | Khoury |
| 3,547,661 | A | 12/1970 | Stevenson |
| 3,709,398 | A | 1/1973 | Fuhrmann |
| 3,737,092 | A | 6/1973 | Rausing |
| 3,854,023 | A | 12/1974 | Levinson |
| 3,941,967 | A | 3/1976 | Sumi et al. |
| 3,952,912 | A | 4/1976 | Perry |
| 3,985,261 | A | 10/1976 | Kulesa |
| 4,046,282 | A | 9/1977 | Ruch |
| 4,081,646 | A | 3/1978 | Goltsos |
| 4,190,757 | A | 2/1980 | Turpin et al. |
| 4,227,624 | A | 10/1980 | Hawkins |
| 4,228,916 | A | 10/1980 | Weingardt |
| 4,351,997 | A | 9/1982 | Mattisson et al. |

(Continued)

FOREIGN PATENT DOCUMENTS

| | | |
|---|---|---|
| CA | 2113812 | 11/1993 |

(Continued)

OTHER PUBLICATIONS

Presser, "Microwave Oven Demonstration," Utah Education Network, created Feb. 10, 2003, available at http://www.uen.org/Lessonplan/preview.cgi?LPid=3456.

(Continued)

*Primary Examiner* — Quang Van
(74) *Attorney, Agent, or Firm* — Sheridan Ross P.C.

(57) ABSTRACT

The present invention describes an apparatus used in conjunction with a metallic container adapted for processing, storing and heating foodstuffs in a microwave oven, and more specifically, a substantially metallic stackable container with a microwavable transparent portion, metallic reinforcing member, and a selectively removable lid, wherein the same container can be used to store, ship, heat, and serve a foodstuff to a consumer.

5 Claims, 16 Drawing Sheets

U.S. PATENT DOCUMENTS

| | | | |
|---|---|---|---|
| 4,388,335 | A | 6/1983 | Schiffmann et al. |
| 4,416,907 | A | 11/1983 | Watkins |
| 4,438,850 | A | 3/1984 | Kahn |
| 4,513,876 | A | 4/1985 | Buchner |
| 4,558,198 | A | 12/1985 | Levendusky et al. |
| 4,560,850 | A | 12/1985 | Levendusky et al. |
| 4,637,543 | A | 1/1987 | Kiicherer |
| 4,641,005 | A | 2/1987 | Seiferth |
| 4,656,325 | A | 4/1987 | Keefer |
| 4,689,458 | A | 8/1987 | Levendusky et al. |
| RE32,739 | E | 8/1988 | Terauds |
| 4,814,568 | A | 3/1989 | Keefer |
| 4,828,135 | A | 5/1989 | Kawakami et al. |
| 4,866,234 | A | 9/1989 | Keefer |
| 4,875,597 | A | 10/1989 | Saunders |
| 4,940,158 | A | 7/1990 | Farrell et al. |
| 4,988,013 | A | 1/1991 | Kobayashi et al. |
| 4,997,691 | A | 3/1991 | Parkinson |
| 5,022,551 | A | 6/1991 | Hexel |
| 5,108,387 | A | 4/1992 | Falk et al. |
| 5,217,307 | A | 6/1993 | McClintock |
| 5,230,914 | A | 7/1993 | Akervik |
| 5,240,131 | A | 8/1993 | Keller |
| 5,246,134 | A | 9/1993 | Roth et al. |
| D345,081 | S | 3/1994 | Adami et al. |
| 5,355,991 | A | 10/1994 | Baranowski |
| 5,725,120 | A | 3/1998 | Ramsey et al. |
| 5,900,264 | A | 5/1999 | Gics |
| 5,961,872 | A | 10/1999 | Simon et al. |
| 6,147,337 | A | 11/2000 | Besser |
| 6,165,115 | A | 12/2000 | Rea |
| 6,213,328 | B1 | 4/2001 | Tiramani et al. |
| 6,221,420 | B1 | 4/2001 | Thomas et al. |
| 6,508,375 | B1 | 1/2003 | Krall |
| D510,024 | S | 9/2005 | Jacober et al. |
| 7,112,771 | B2 | 9/2006 | Richardson et al. |
| 2003/0038131 | A1 | 2/2003 | Nomura et al. |
| 2005/0199617 | A1 | 9/2005 | Richardson et al. |
| 2005/0199619 | A1 | 9/2005 | Richardson et al. |
| 2007/0102425 | A1 | 5/2007 | Richardson et al. |
| 2007/0108196 | A1 | 5/2007 | Richardson et al. |
| 2007/0108197 | A1 | 5/2007 | Richardson et al. |
| 2007/0108198 | A1 | 5/2007 | Richardson et al. |

FOREIGN PATENT DOCUMENTS

| | | |
|---|---|---|
| CN | 1085180 | 4/1994 |
| CN | 1395899 | 2/2003 |
| CN | 1396098 | 2/2003 |
| DE | 4102053 | 10/1992 |
| DE | 4124208 | 1/1993 |
| EP | 0344839 | 12/1989 |
| EP | 0487166 | 5/1992 |
| EP | 0875370 | 1/1998 |
| EP | 1144258 | 10/2001 |
| FR | 2666073 | 2/1992 |
| GB | 2134495 | 8/1984 |
| JP | 01-131634 | 5/1989 |
| JP | 05229558 | 9/1993 |
| JP | 05305935 | 11/1993 |
| JP | 08085546 | 4/1996 |
| JP | 2001247157 | 9/2001 |
| NZ | 0333393 | 4/2001 |
| WO | WO 92/03355 | 3/1992 |
| WO | WO 92/12904 | 8/1992 |
| WO | WO 93/22219 | 11/1993 |
| WO | WO 9611142 | 4/1996 |
| WO | WO 0041935 | 7/2000 |
| WO | WO 2004033324 | 4/2004 |

OTHER PUBLICATIONS

Shiokawa Shun'ichi, Masai Singo, "Development of Food Container for Microwave." JPI Journal, 2000, vol. 38, No. 6, p. 610-615, ISSN:0385-728X (Abstract Only).

Official Action for European Application No. 05711967, dated Aug. 26, 2009.

Notice of Acceptance for Australian Application No. 2006216587, mailed Feb. 24, 2010.

Official Action for Australian Application No. 2005227549, dated Apr. 23, 2010.

European Search Report for European Patent Application No. 06736031, dated Sep. 16, 2009.

Official Action for European Patent Application No. 06736031, dated Oct. 22, 2009.

Official Action for European Application No. 05711967, dated Aug. 18, 2010.

Official Action for Israel Patent Application No. 185393, mailed Oct. 3, 2010.

Official Action for Canada Patent Application No. 2598697, mailed Sep. 24, 2010.

Supplementary European Search Report for Application No. EP 05711967, dated Oct. 16, 2008.

"Microwave Oven. Microwave Knowhow. How a Microwave Oven Cooks", Samsung's Digital World website, as early as Jul. 7, 2003, available at http://www.samsung.com/Products/MicrowaveOven/cookbook/micro_knowhow.htm, printed on Feb. 20, 2009, pp. 1-4.

"You and Your Microwave", KFL & A Health Unit website, as early as Jan. 19, 2003, available at http://www.healthunit.on.ca/factsheets/dp.cfm?action=Fact_Sheets_Details&ContentID=114, printed Feb. 20, 2009, pp. 1-3.

"The Safe Use of Cookware", Health Canada -It's Your Health—Products website, as early as Aug. 18, 2002, available at http://www.hc-sc.gc.ca/english/iyh/products/cookware.html, printed Feb. 20, 2009, pp. 1-4.

Author Unknown, "Present Status of the development and prospects of packaging for use in the microwave oven-New plastic containers in place of metallic cans", Gekkan Shokuhin Ryutsu Gijutsu, 1987, vol. 16, No. 15, pp. 9-12; ISSN: 0913-9060.

Official Action for Australian Application No. 2006216587, mailed Feb. 12, 2009.

Official Action for European Patent Application No. 05711967.9, dated Feb. 1, 2011, 4 pages.

Official Action for Mexico Patent Application No. MX/a/2007/010274, dated Jan. 6, 2011 4 pages.

Official Action (including translation) for Japan Patent Application No. 2007-502802, mailed Mar. 1, 2011 8 pages.

U.S. Appl. No. 29/208,745, Jacober et al.

MICROWAVABLE METALLIC CONTAINER

This application is a Continuation-In-Part of U.S. patent application Ser. No. 11/064,224, filed Feb. 22, 2005, which is a Continuation-In-Part of U.S. patent application Ser. No. 10/797,749, now U.S. Pat. No. 7,112,771, filed Mar. 9, 2004, both applications being incorporated by reference in their entirety herein.

FIELD OF THE INVENTION

The present invention relates to food and beverage containers, and more specifically metallic containers used for perishable foodstuffs which can be heated in a microwave oven.

BACKGROUND OF THE INVENTION

With the introduction of the microwave oven, a huge demand has been created for disposable food and beverage containers which may be heated in conventional microwave ovens. These containers eliminate the necessity of utilizing a separate microwavable bowl and the inconvenience related thereto, and provide a container which is used for both storing food and beverage items, heating those items, and subsequently using the container as a serving bowl or tray. Following use, the microwavable bowl may be conveniently discarded or recycled rather than cleaned. As used herein, the term "foodstuffs" applies to both solid and liquid food and beverage items, including but not limited to pasteurized liquids such as milk products, soups, formula, and solids such as meats, vegetables, fruits, etc.

In general, metal containers have not been utilized for heating foodstuffs in microwave ovens due to the likelihood of electrical "arcing", and the general public misconception that metal materials are incapable of being used in conventional microwave ovens. Although previous attempts have been made to design microwavable metal containers, these products have generally been very limited and impractical in their design and use. For example, U.S. Pat. Nos. 4,558,198 and 4,4689,458 describe microwavable metal containers which have height limitation of less than about 1 inch, and are thus not practical for storing any significant volume of foodstuffs.

U.S. Pat. No. 5,961,872 to Simon et al, (the '872 patent") discloses a microwavable metal container which utilizes a microwavable transparent material. However, the '872 patent does not utilize a hermetic seal which is sufficient to safely store food items under a vacuum for long periods of time, and which requires that the entire lower portion and sidewall of the metal container be enclosed within an electrical insulation material to prevent arcing. Further, the device requires that the side walls of the container have a height less than about 40 percent of the wavelength of the microwave radiation used to heat the object, which is not overly practical or functional.

More recent attempts to store and cook food in microwavable containers have been accomplished by using non-metallic plastic and foam type materials. Although these products are suitable for use in microwave ovens, and are generally accepted by the consuming public, they have numerous disadvantages when compared to metallic containers. More specifically, non-metallic foam and plastic containers have very poor heat transfer characteristics, and these types of containers require significant more time to heat and cool in a food processing plant. Thus, these types of containers are very time-consuming and expensive to fill and sterilize during filling operations, and are thus inefficient for mass production.

Further, non-metallic containers are not as rigid as metal containers, and thus cannot be stacked as high as metal containers which limits the volume which can be shipped, and thus increases expenses. Additionally, non-metallic containers are not durable, and are prone to damage and leaking during shipment and placement for sales, thus adding additional expense. Furthermore, multi layer barrier plastics and foams are generally not recyclable like metal containers, which fill landfills and are thus not environmentally friendly.

Finally, foodstuffs cooked in non-metallic plastic and foam containers in a microwave oven generally overheat and burn next to the container surface, while the foodstuffs in the center of the container heat last, and thus require stirring or remain cold. Further, there are general health concerns regarding the possible scalping of chemicals and the subsequent altered taste when cooking foods in non-metallic containers, especially since non-metallic plastics and foams can melt and deform when overheated.

Thus, there is a significant need in the food and beverage container industry to provide an economical metallic container which may be used for cooking foodstuffs in a microwave oven and which eliminate many of the health, shipping and filling problems described above.

SUMMARY OF THE INVENTION

It is thus one aspect of the present invention to provide a metallic, microwavable metal container which is hermetically sealed and capable of storing foodstuffs for long periods of time. Thus, in one embodiment of the present invention, a metallic container is provided with a lower end of a sidewall sealed to a non-metallic microwavable transparent material. Preferably, the microwavable transparent material and sidewall are double seamed to a reinforcing material and may additionally utilize a sealant material to create a hermetic, long lasting, airtight seal.

It is a further aspect of the present invention to provide a microwavable metal container which generally heats foodstuffs contained therein from the "inside out", rather than the "outside in" as found with conventional plastic and foam containers. Thus, in one embodiment of the present invention a container with a unique geometric shape is provided, and while the microwavably transparent material on the lower end of the container has a surface area of at least about 1.25 square inches. More specifically, the metallic container in one embodiment has an upper portion with a greater diameter than a lower portion of the container, and thus has a substantially conical geometric shape which facilitates efficient cooking of the foodstuffs contained therein.

It is a further aspect of the present invention to provide a microwavable metallic container which utilizes well known materials and manufacturing processes which are well accepted by both the container industry and consumers alike. Thus, in one aspect of the present invention a microwavable metallic container is provided which is compiled of steel, aluminum, tin-coated steel, and which utilizes a microwavable transparent material comprised of materials such as polypropylene/EVOH, polyethylene, polypropylene and other similar materials well known in the art. Furthermore, the microwavably transparent material may be interconnected to the sidewall of the metallic container with a metallic or plastic reinforcing member by a double seaming process that is well known in the metallic container manufacturing industry, and which is capable of interconnecting multiple layers of materials. Alternatively, or in conjunction with the double seaming process the microwavable transparent material may be welded or chemically adhered to a flange portion of the container sidewall or reinforcing member.

Alternatively, it is another aspect of the present invention to provide a microwavable metallic container which utilizes a microwavable transparent material which is welded or chemically sealed to a lower end of the metallic container sidewall. Thus, in one embodiment of the present invention there is no double seaming required to interconnect the metallic container sidewall to the microwavable transparent material, nor is a reinforcing member necessary for support since sufficient rigidity is obtained with the metallic sidewall and microwavable transparent bottom portion.

Thus in one aspect of the present invention a metallic microwave container adapted to store a beverage or a foodstuff is provided, comprising:

a metallic container body with an upper end, a lower end, and sidewalls extending therebetween;

an end closure interconnected to an upper end of said container body;

a microwave transparent material interconnected to said lower end of said metallic container sidewall which allows microwave energy to pass into said metallic microwavable container from said lower end.

It is another aspect of the present invention to provide a bowl or container shape which is more efficient with regard to heating the foodstuffs within the container. Thus, in one aspect of the present invention a container is provided which utilizes an upper portion with a greater diameter than a lower portion, or alternative a lower portion with a greater diameter than an upper portion. Alternatively, a container which has an upper portion with substantially the same diameter upper portion and lower portion may be utilized.

Thus, in another aspect of the present invention, a microwavable metallic container is provided that comprises:

a container body with an upper end, a lower end and sidewalls extending therebetween;

an end closure interconnected to an upper end of said container body;

a substantially concentric metallic ring interconnected to a lower end of said container body, comprising:

a first end adapted for operable engagement to said lower end of said container body;

an outer panel wall interconnected to said first end and extending downwardly therefrom;

an inner panel wall interconnected to said outer panel wall to form a countersink at a lowermost portion and a first leg extending upwardly therefrom;

an upper ledge extending inwardly from said inner panel wall first leg;

a second end interconnected to said upper ledge and oriented outwardly toward said inner panel wall; and a microwave transparent material interconnected to an exterior surface of said at least one of an exterior surface of said ring second end, said upper ledge and said inner panel wall.

The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
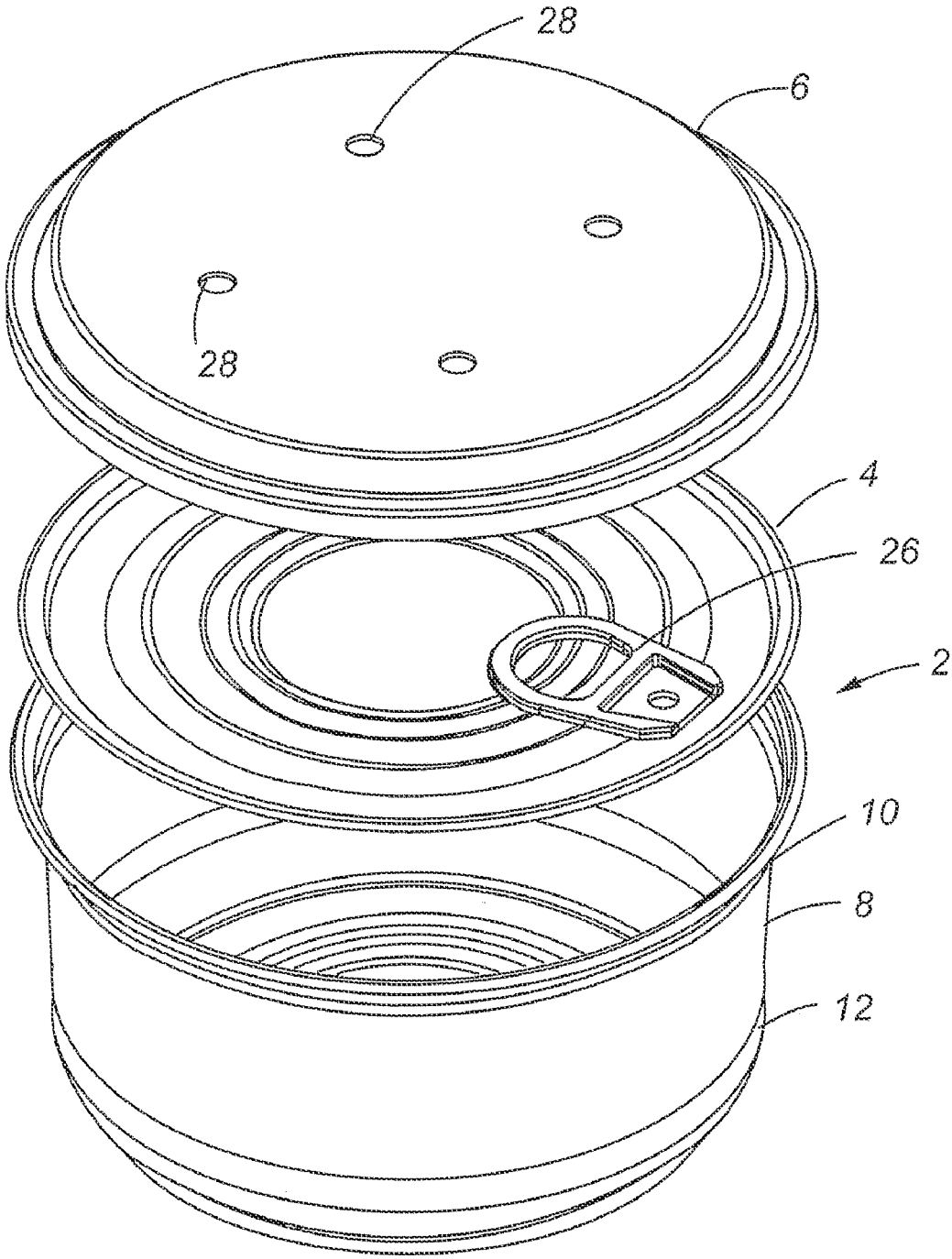
FIG. 1 is a front exploded perspective view of a metallic microwavable bowl.

To assist in the understanding of the present invention the following list of components and associated numbering found in the drawings is provided herein:

| # | Components |
|---|---|
| 2 | Microwavable container |
| 4 | Metal lid |
| 6 | Removable plastic lid |

-continued

| # | Components |
|---|---|
| 8 | Metallic sidewall |
| 10 | Metallic sidewall upper portion |
| 12 | Metallic sidewall lower portion |
| 14 | Microwavable transparent material |
| 16 | Bottom reinforcing member |
| 18 | Peripheral edge of microwavable transparent material |
| 20 | Sealant material |
| 22 | Weld |
| 24 | Insulative material |
| 26 | Pull tab |
| 28 | Venting apertures |
| 30 | Double seam |
| 32 | Outer panel wall |
| 34 | U-shaped countersink |
| 36 | Ring Inner panel wall |
| 38 | Ring inner panel wall lip |
| 40 | Ring second end |
| 42 | Ring inner surface |
| 44 | Ring 180 degree bend |
| 46 | Ring inwardly extending ledge |
| 48 | Ring outwardly extending ledge |
| 50 | Container side wall lower end |
| 52 | Container sidewall exterior edge |
| 54 | Container sidewall interior edge |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Referring now to the drawings, FIGS. 1-17 depict various embodiments of a metallic microwavable bowl. Referring now to FIG. 1, a microwavable container 2 of the present invention is provided in an exploded view, and which identifies a metal lid 4 with interconnected pull tab 26, as well as a removable plastic lid 6 which is positioned thereon. In use, the metal lid 4 is hermetically sealed to the metallic side wall upper portion 10 of the container after the foodstuff is placed in the container during filling operations. During use, the metal lid 4 is removed from the metallic sidewall 8, and the removable plastic lid 6 is positioned on an upper end of the metallic side wall 8, to prevent splattering and to improve the heating of the foodstuff contained in the microwavable container 2. A microwave transparent material 14 is generally interconnected to either a lower portion of the container metallic sidewall 12, on alternatively to a bottom reinforcing member 16.

Figure 2:
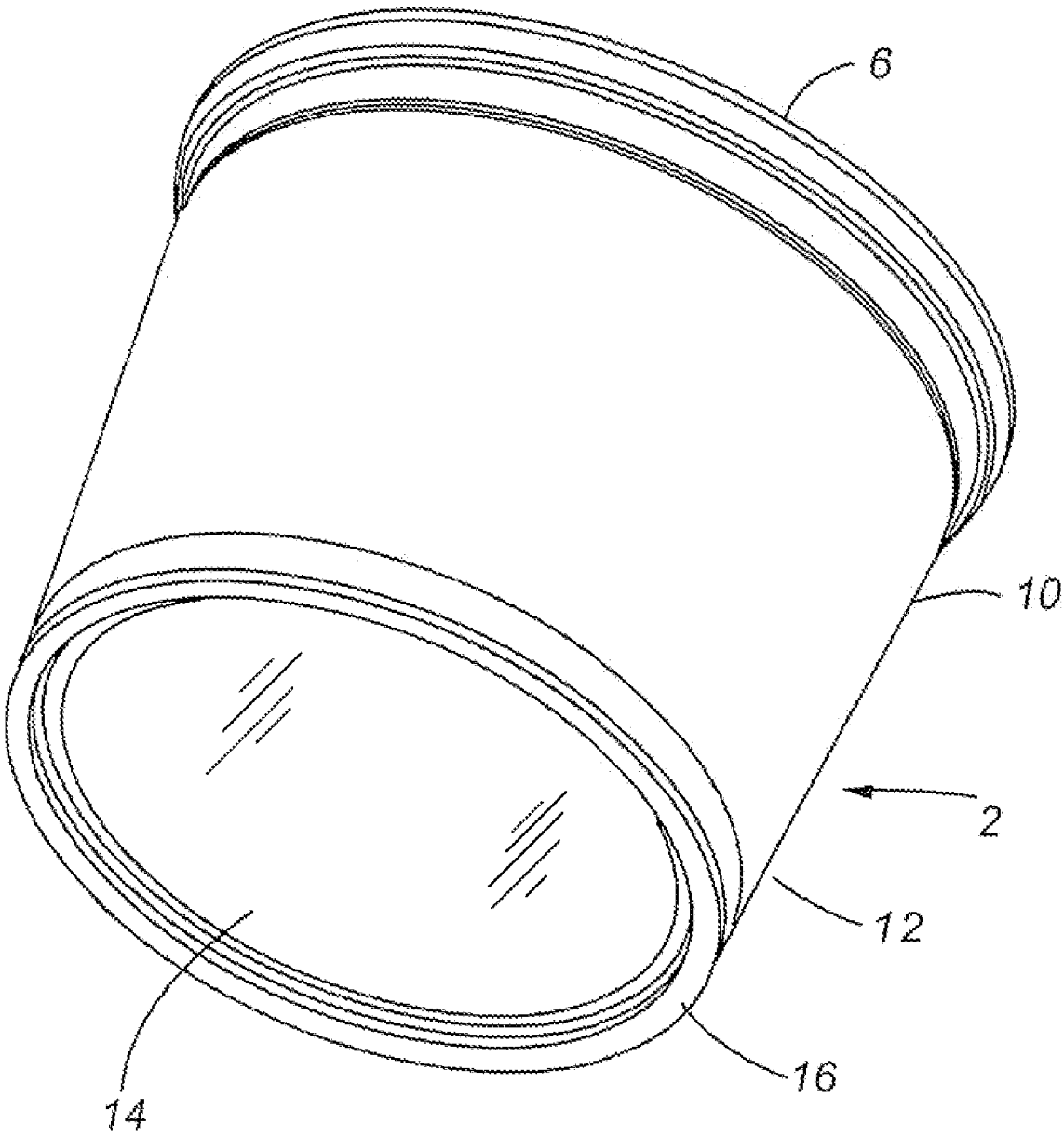
FIG. 2 is a bottom perspective view of one embodiment of the invention identified in FIG. 1, and identifying a metallic microwavable bowl with a microwavable transparent material on a bottom portion.

Referring now to FIG. 2, the microwavable container 2 of FIG. 1 is provided herein as viewed from the bottom. More specifically, the microwavable container 2 comprises a metallic side wall 8 which includes a sidewall upper portion 10, a metallic sidewall lower portion 12, and a reinforcing member 16 which is used in one embodiment to interconnect the microwavable transparent material 14 to the metallic sidewall 8. In one embodiment of the present invention the microwavable transparent material 14 is comprised of a polyethylene, a polypropylene/EVOH, a nylon, a PET or other plastics, and as appreciated by one skilled in the art can comprise any number of materials which allow the transmission of micro energy, through the material and into the container 2.

Furthermore, in a preferred embodiment of the present invention, the microwavable transparent bottom portion 14 has a cross sectional area of at least about 1.25 square inches to allow optimum heating of the foodstuff contained within the microwavable container 2. The bottom reinforcing member 16 is generally used for interconnecting the metallic sidewall lower portion 12 to the microwavable transparent bottom portion 14, and is generally comprised of a metal material such as aluminum, or steel. However, as appreciated by one skilled in the art this material may also be comprised of a plastic material such as polypropylene, polyethylene or other well known materials in the art.

Figure 3:
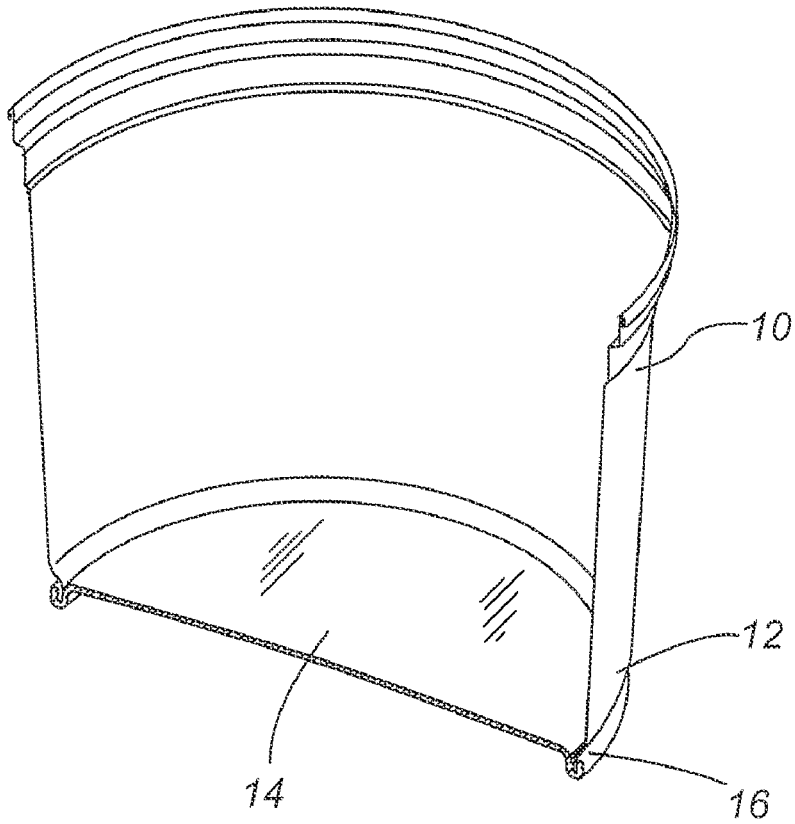
FIG. 3 is a cross-sectional view of the container shown in FIG. 2.
Figure 4:
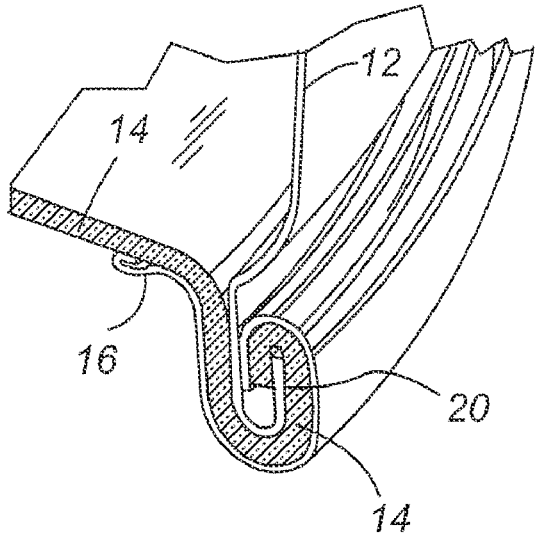
FIG. 4 is a detail of FIG. 3.

Referring now to FIGS. 3 and 4, a sectional view of one embodiment of a microwavable container 2 is provided along with a detail of the double seam used to interconnect the microwavable transparent bottom portion 14 to the metallic sidewall lower portion 12 and the bottom reinforcing member 16. As shown in FIG. 4, a conventional double seam 30 is used in one embodiment of the present invention and which effectively interconnects the bottom reinforcing member 16 to the peripheral edge 18 of a microwavable transparent material 16 and to a lower portion of the metallic sidewall 12. Additionally, a sealant material 20 may be positioned between the metallic sidewall lower portion 12, the microwavable transparent material 18, or the bottom reinforcing member 16 to assure a hermetic seal of the microwavable container 2. Preferably the sealant 20 is comprised of an elastomer, a silicon or a latex based material, although other sealant materials known in the art may be used for the same purpose.

Figure 5:
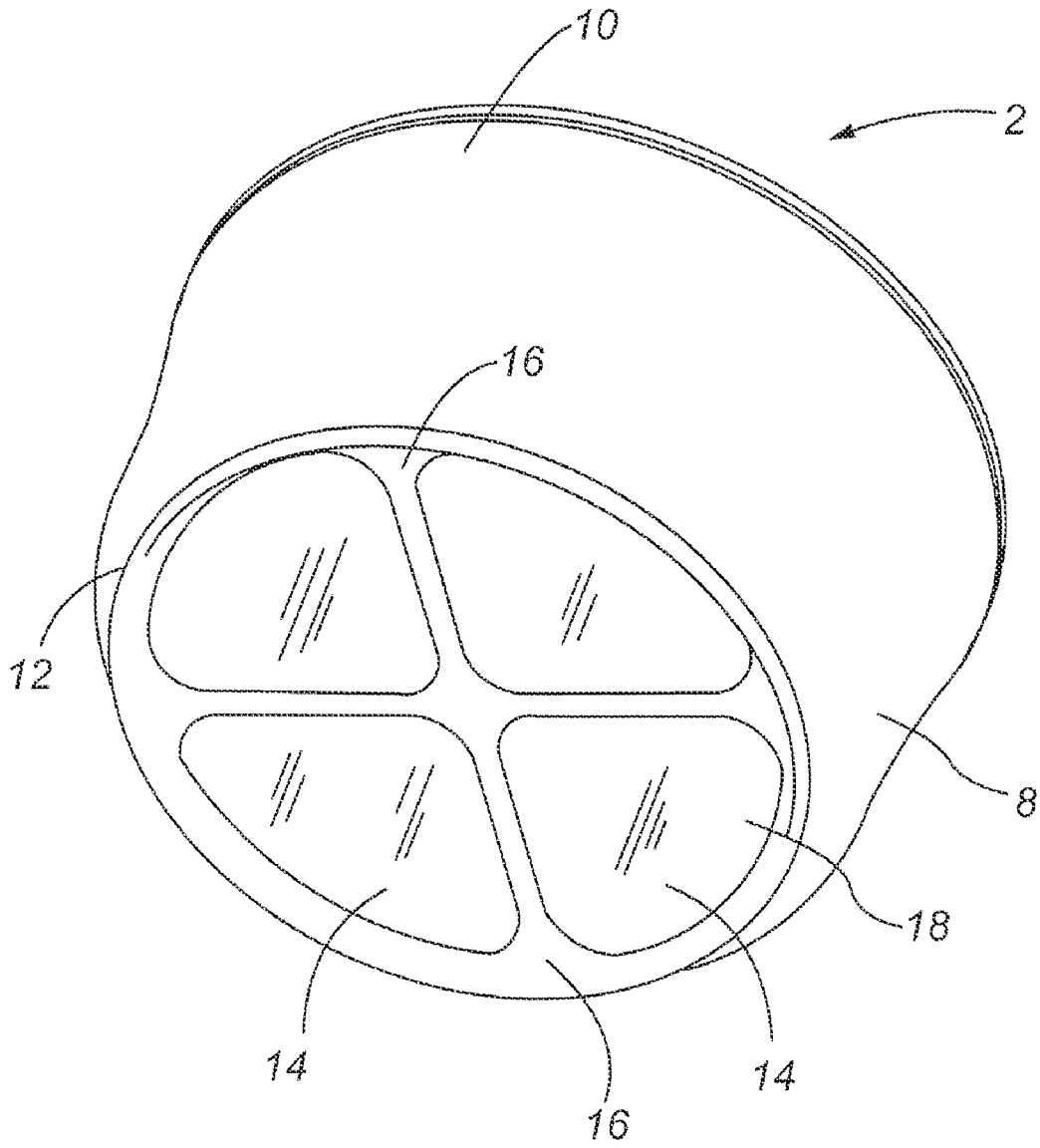
FIG. 5 is a bottom perspective view of an alternative embodiment of the present invention.

Referring now to FIG. 5, an alternative embodiment of the present invention is depicted by a bottom perspective view of a microwavable container 2 which utilizes an alternative geometric shape for the microwavable transparent material 14. In this embodiment additional rigidity is provided with the bottom reinforcing member 16 which creates 4 individual sections of the microwavable transparent material 18. As appreciated by our skilled in the art, any variety of geometric shapes and configurations may be used on the bottom portion of the container for ornamental or functional purposes. Preferably, and as stated above, the microwavable transparent material 18 has a surface which is sufficient to heat the foodstuffs contained within the microwavable container 2 in a timely manner, and is preferably at least about 1.25 square inches, and more preferably about 3.0 square inches.

Figure 6:
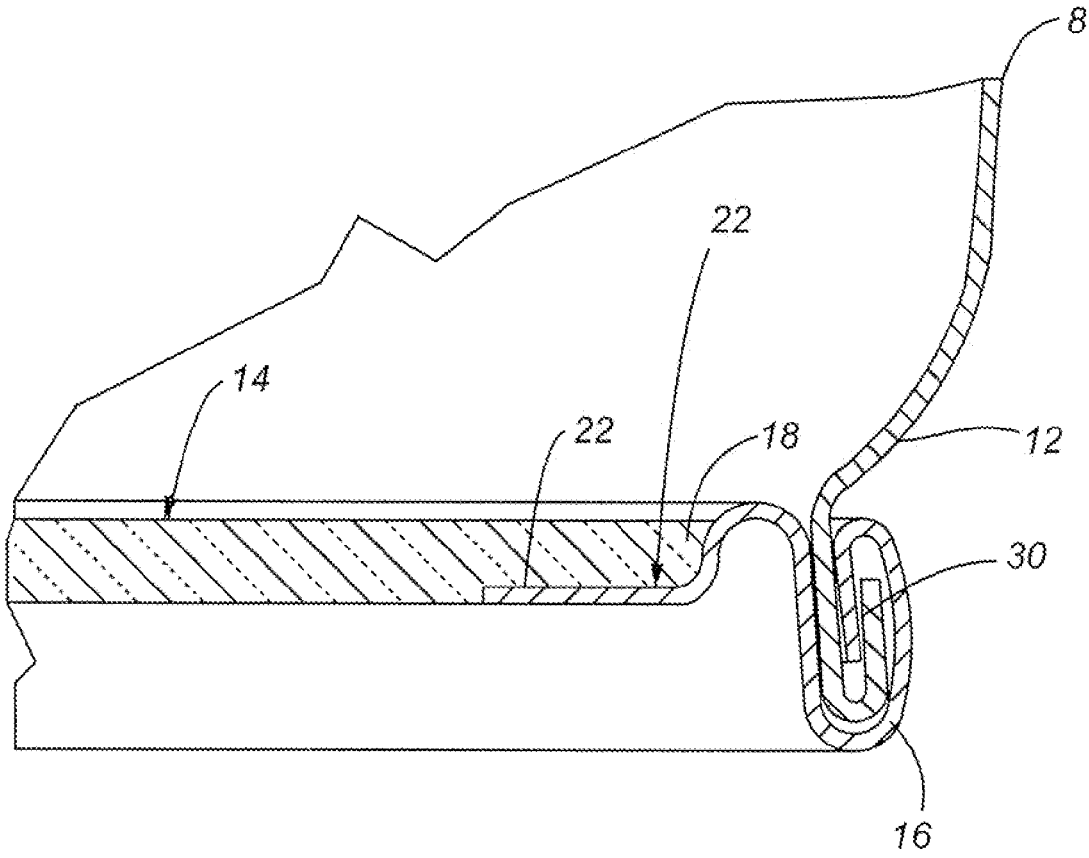
FIG. 6 is a partial cross-sectional front elevation view depicting an alternative embodiment of a lower portion of a metal microwavable bowl.

Referring now to FIG. 6, a partial cross-sectional view of the container 2 is shown which depicts the lower sidewall 12 of the container the reinforcing member 16, the ring second end 40, a u-shaped countersink 34, and the microwave transparent material 14 which is interconnected to the reinforcing member 16.

Figure 7:
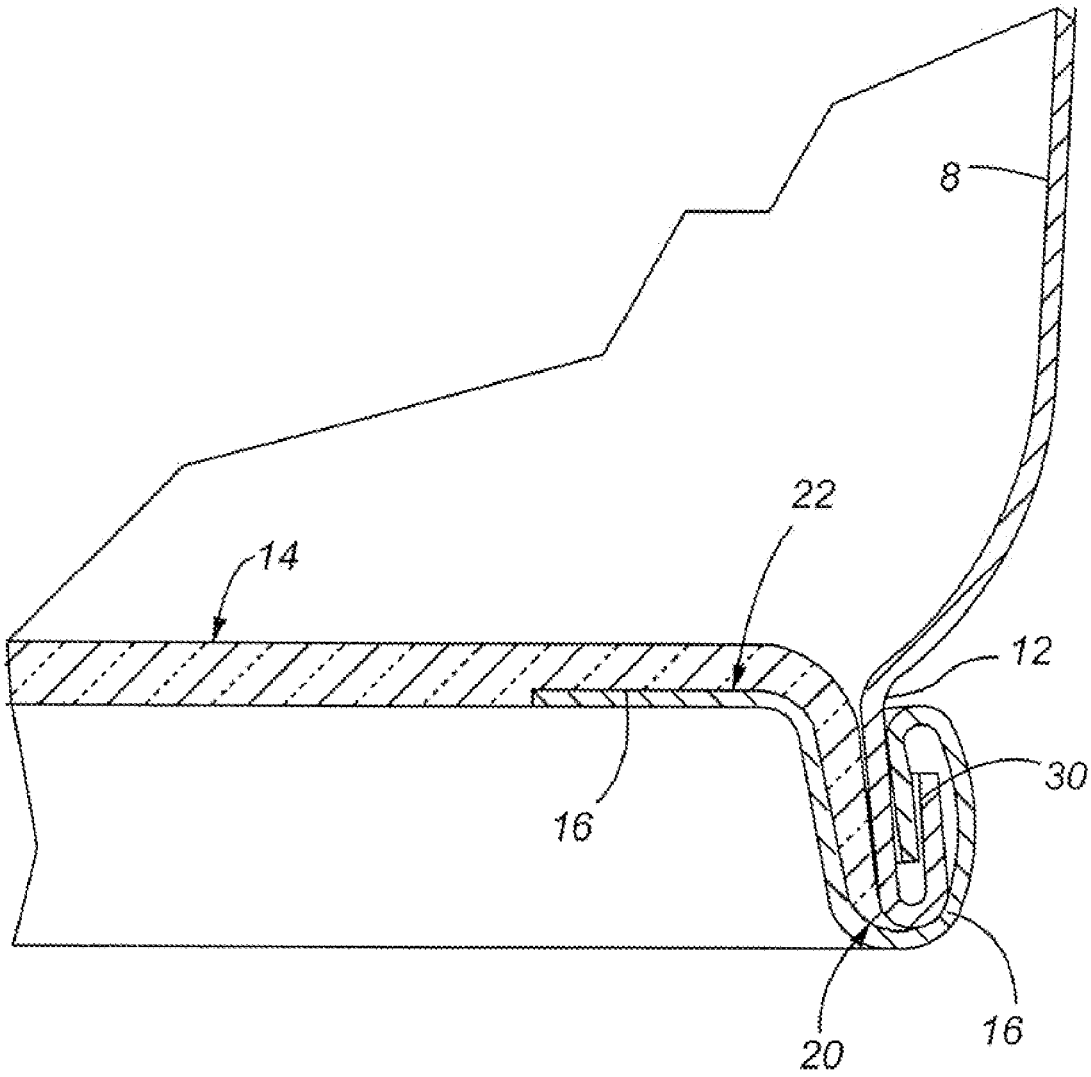
FIG. 7 is a partial cross-sectional front elevation view of an alternative embodiment of a lower portion of a metal microwavable bowl.
Figure 8:
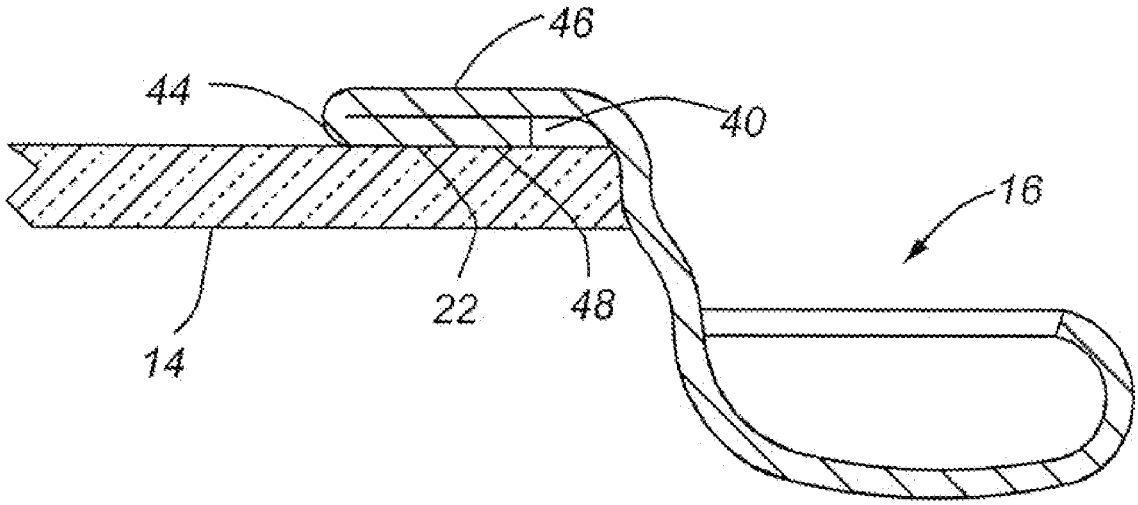
FIG. 8 is a partial cross-sectional front elevation view of an alternative embodiment of a lower portion of a metal microwavable bowl shown before double seaming to the lower end of the container.

Referring now to FIG. 7, a sectional front elevation view of a lower portion of alternative embodiment of a microwavable container 2 are provided. More specifically, various embodiments are provided that show the interconnection of the microwavable transparent material 18, the bottom reinforcing member 16, and the lower portion of the sidewall 12. More specifically, a weld 22 is provided that effectively interconnects the microwavable transparent material 18 to the bottom reinforcing member 16 along an upper edge of the bottom reinforcing material 16. The weld 22 in this embodiment extends over a portion of the bottom reinforcing member 16 and along a portion of the bottom edge. Referring now specifically to FIG. 8, a cross-sectional front elevation view is provided of an alternative embodiment of the present invention wherein the bottom reinforcing member 16 is shown prior to double seaming to the metallic sidewall 8 of a metallic container. More specifically, the bottom reinforcing member 16 includes an upper portion adapted for double seaming to a lower end of the container sidewall, and a reinforcing ring second end 40 which is bent and oriented outwardly. The bend in the second end of the reinforcement member 16 defines an inwardly extending edge 46 and an outwardly extending edge 48. The outwardly extended edge 48 is adapted to the welded 22 or otherwise interconnected to the microwavable transparent material 14. The microwave transparent material 14 may additionally be welded below the lower ledge 48 and where the microwave transparent material 4 contacts the inner wall of the reinforcing member 16. By positioning the reinforcing end second end 40 between the inner ledge 46 and the microwave transparent material 14, the ring second end 40 is substantially prevented from exposure to oxygen, and the likelihood for further contamination.

Figure 9:
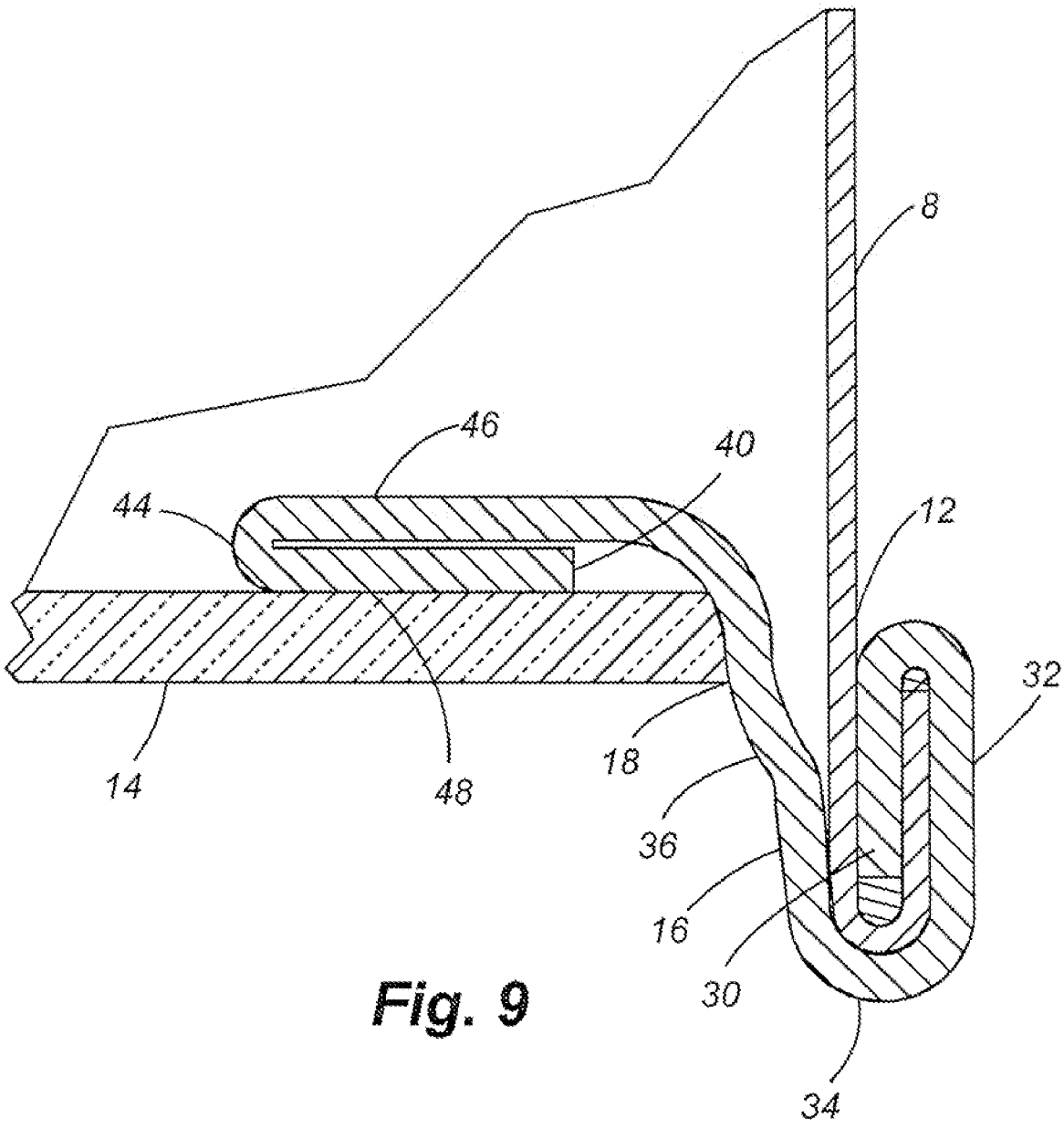
FIG. 9 is a partial cross-sectional front elevation view of the invention of FIG. 8 after double seaming to a lower portion of the container.

Referring now to FIG. 9, the reinforcing member 16 shown in FIG. 8 is shown in a front cross-sectional elevation view after the reinforcing member 16 is double seamed to the lips double seam 30 to the container sidewall 8. By interconnecting the reinforcing member on one end to the container 8 and an opposing end to a microwavable transparent material 14, a U-shaped countersink 34 is formed which serves the additional purpose of elevating the microwave transparent material 14 above the lower most portion of the container to allow microwave energy to pass through the microwave transparent material 14.

Figure 10:
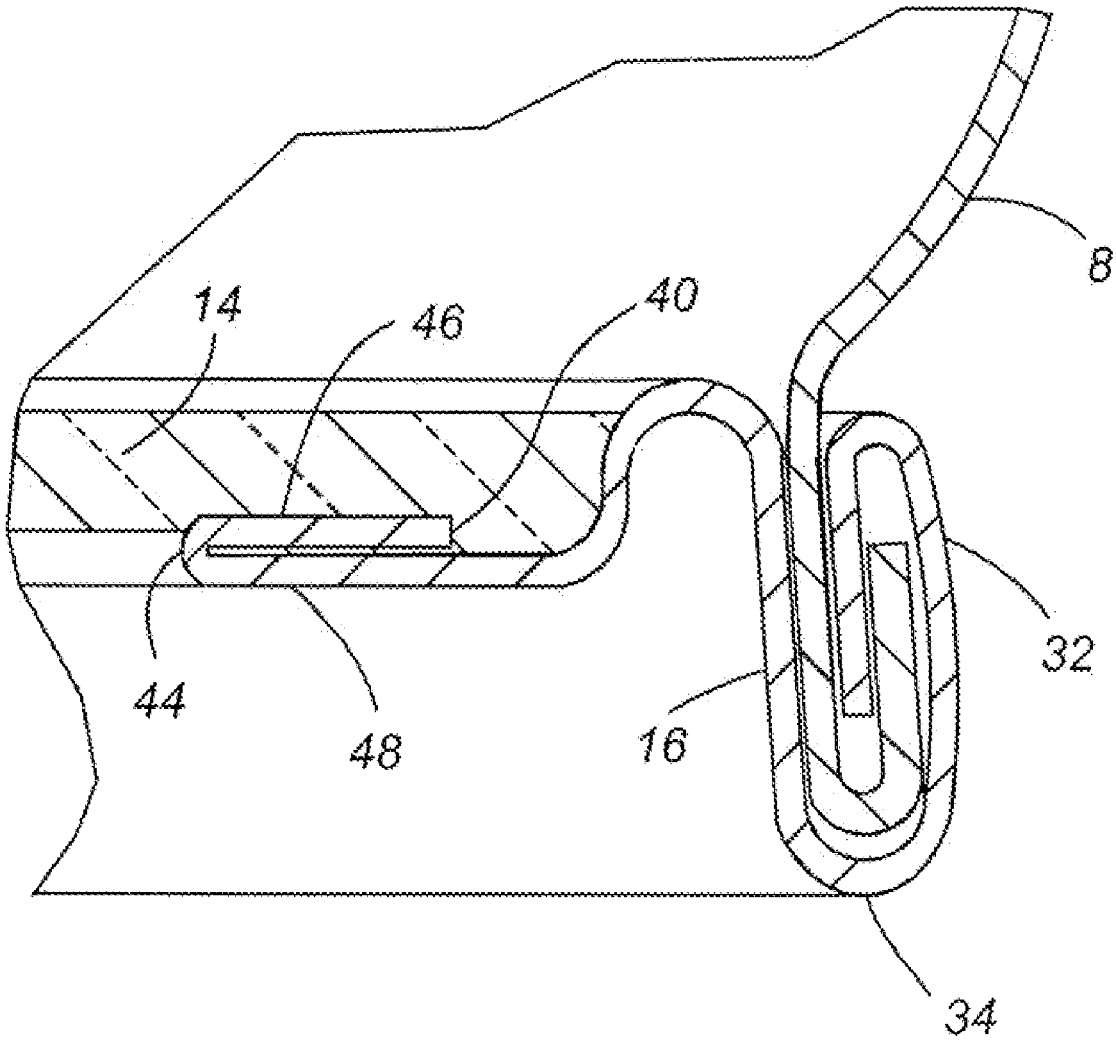
FIG. 10 is a partial cross-sectional front elevation view of a lower portion of a metal microwavable bowl, and identifying an alternative embodiment.

Referring now to FIG. 10, an alternative embodiment of the present invention is provided wherein the reinforcing member 16 is shown with the second end 40 curled inwardly in a different orientation from that shown in FIG. 9. In this embodiment, the microwave transparent material is positioned on the inwardly extending ledge 46 while the ring outward extending edge 48 is exposed. As shown in this embodiment, the ring second end 40 is still isolated from exposure to oxygen, and is further prevented from being in contact with foodstuffs or other liquids contained within the microwavable container 2.

Figure 11:
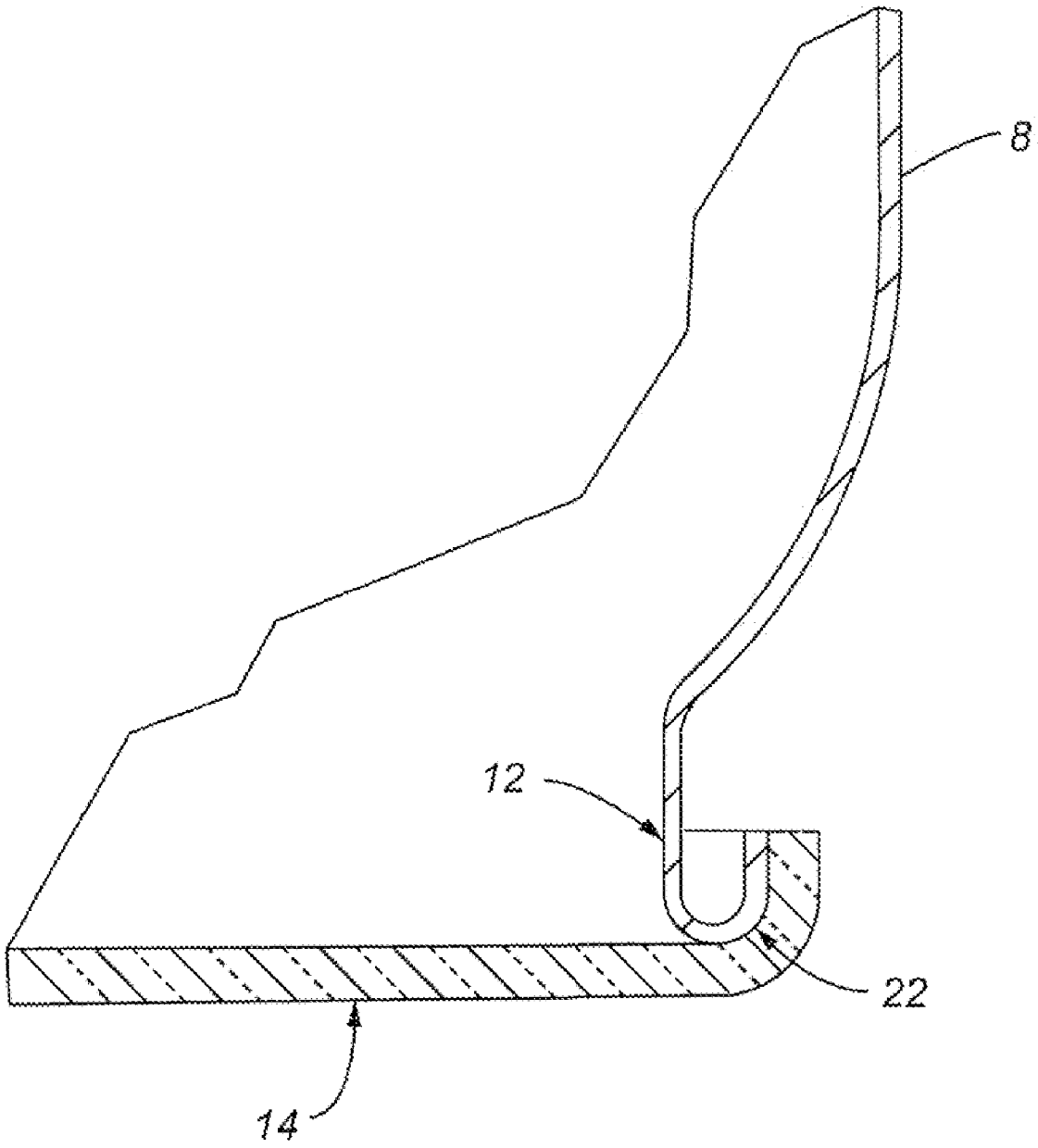
FIG. 11 is a partial cross-sectional front elevation view of a lower portion of a metal microwavable bowl, and identifying an alternative embodiment.
Figure 12:
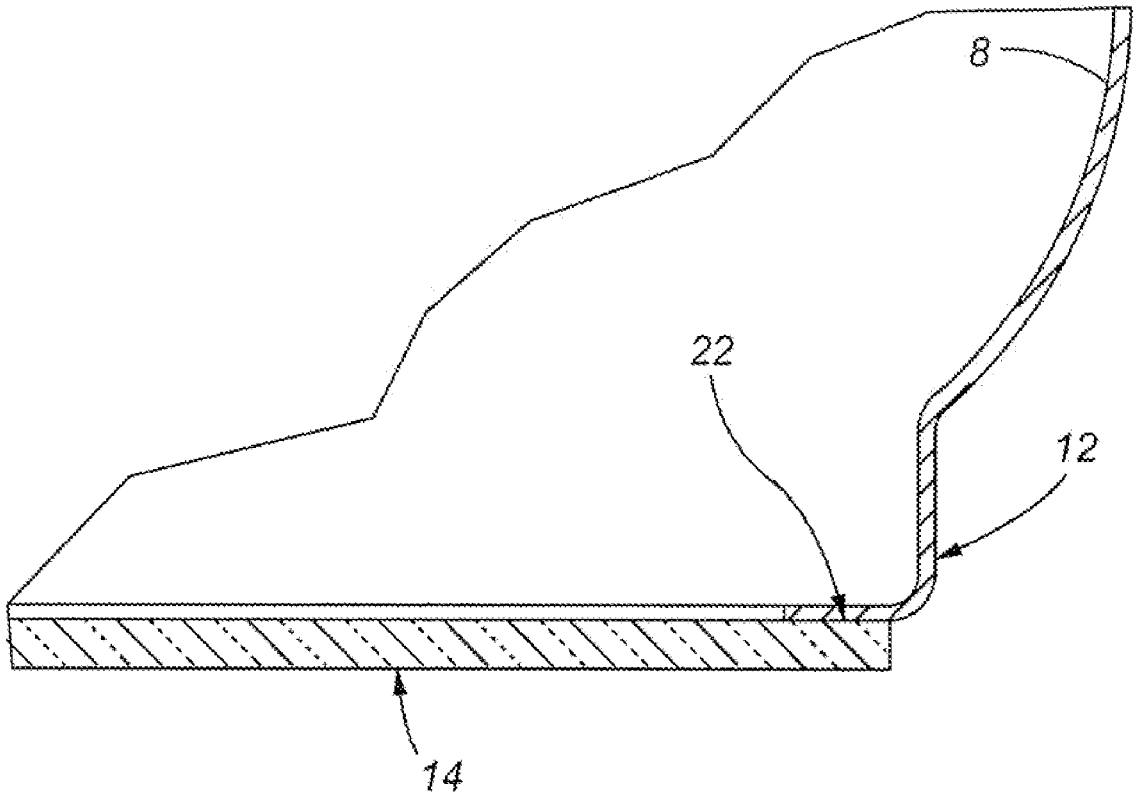
FIG. 12 is a partial cross-sectional front elevation view of a lower portion of a metal microwavable bowl, and identifying an alternative embodiment.

Referring now to FIGS. 11 and 12, alternative embodiments of the present invention are provided, wherein a double seam and reinforcing member is not utilized to interconnect the microwavable transparent material 14 to a lower portion of the container sidewall 12. Rather, the microwavable container 2 rests completely on the microwavable transparent material 14, and there is no requirement for a bottom reinforcing material. As depicted, the lower portion of the container sidewall 12 is merely welded 22 directly to the microwavable transparent material 14 to create an airtight seal, thus eliminating entirely the requirement for the reinforcing material 16 and the step of double seaming these materials together.

Figure 13:
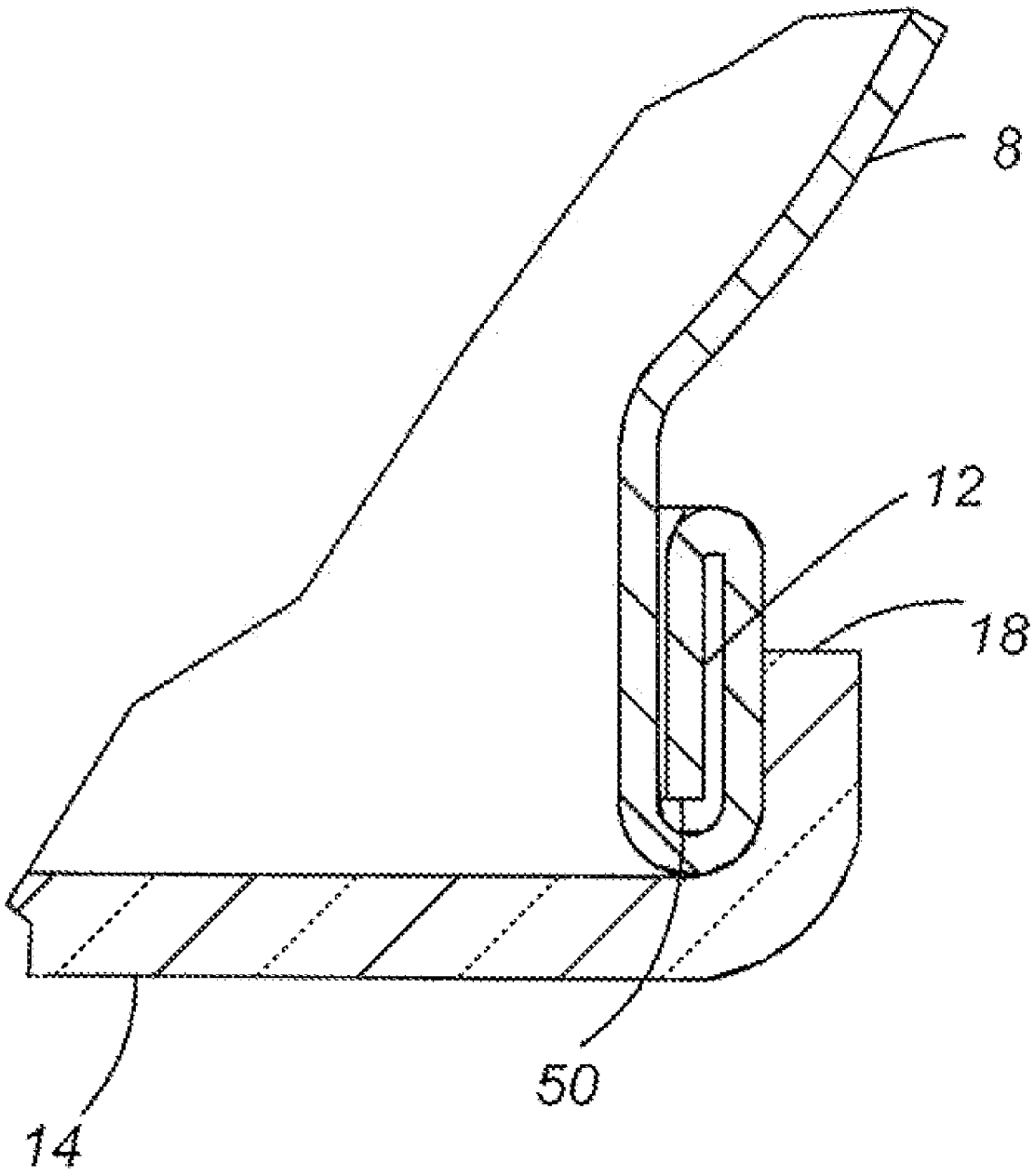
FIG. 13 is a partial cross-sectional front elevation view of a lower portion of a metal microwavable bowl, and identifying an alternative embodiment.

Referring now to FIG. 13, yet another embodiment of the present invention is provided where the bottom reinforcing member is completely eliminated from the microwavable container 2. In this specific embodiment, the container sidewall 8 has a lower end 50 which is bent inwardly and downwardly to form a substantially 180 degree curve at an uppermost portion. This orientation is provided to again isolate the ring of the container lower end 50 from oxygen and possible rusting or contamination. In this embodiment, the microwave transparent material 14 is welded or otherwise interconnected to the lower end of the container sidewall at one or more locations by ultrasonic welding or other means commonly known in the art.

Figure 14:
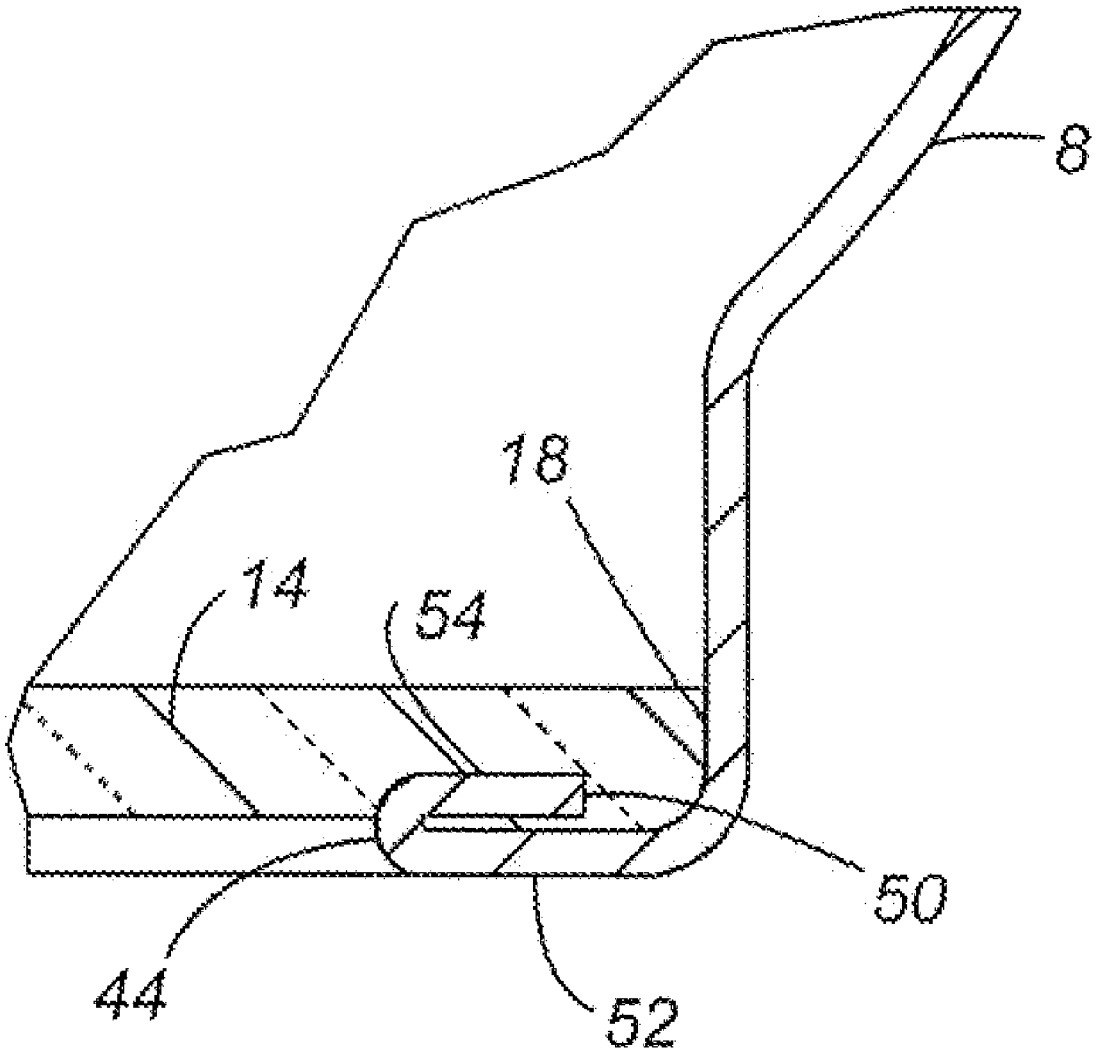
FIG. 14 is a partial cross-sectional front elevation view of a lower portion of a metal microwavable bowl, and identifying an alternative embodiment.

Referring now to FIG. 14, another embodiment of the present invention is provided herein wherein the container sidewall lower end 50 is bent inwardly to form an exterior ledge 52 and an interior ledge 54. In this embodiment the interior ledge 54 is adapted for positioning proximate to the microwave transparent bottom portion 14 and is oriented once again to prevent exposure to oxygen. The microwave transparent material 14 is welded by ultrasonic welding to the container sidewall interior edge 54 and/or to the peripheral edge of the microwavable transparent material 18.

Figure 15:
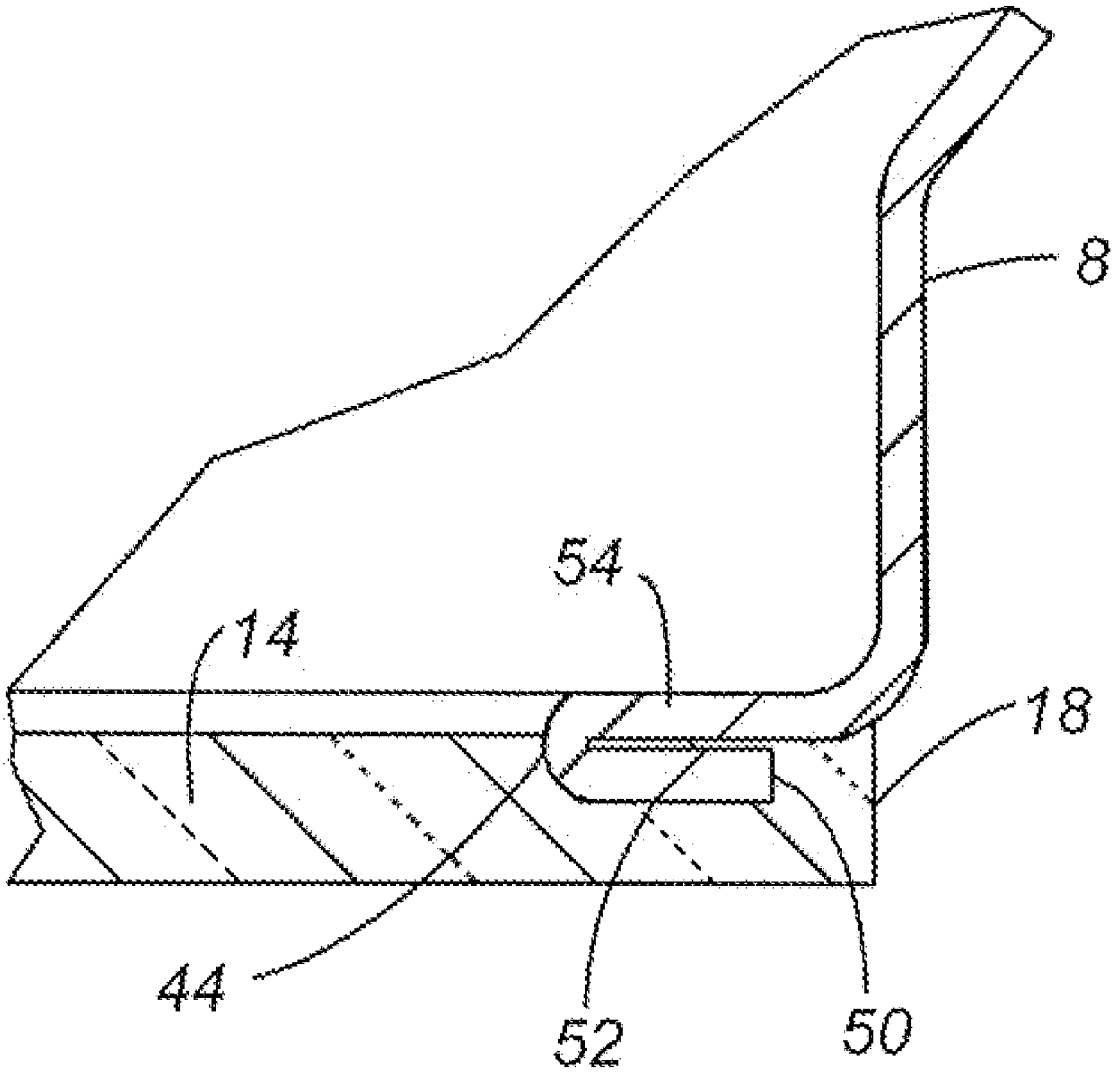
FIG. 15 is a partial cross-sectional front elevation view of a lower portion of a metal microwavable bowl, and identifying an alternative embodiment.
Figure 16:
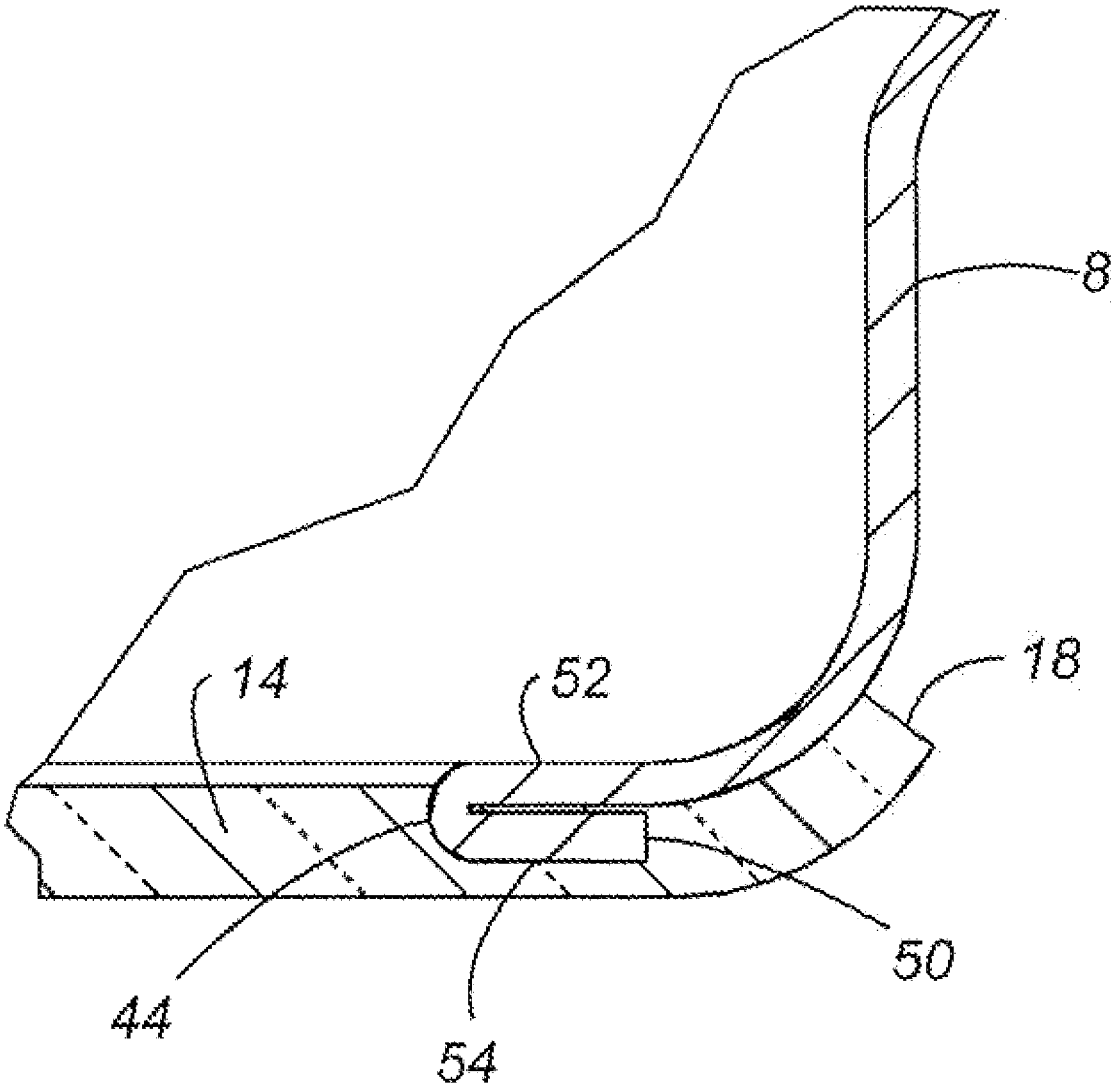
FIG. 16 is a partial cross-sectional front elevation view of a lower portion of a metal microwavable bowl, and identifying an alternative embodiment.

Referring now to FIGS. 15 & 16, other embodiments of the present invention provide a container sidewall lower end 50 that is bent outwardly to form a container sidewall interior edge 54 and a container sidewall exterior edge 52. In these embodiments the microwave transparent material 14 is positioned proximate to and interconnected to exterior ledge 52 and/or the container sidewall lower end 50.

Figure 17:
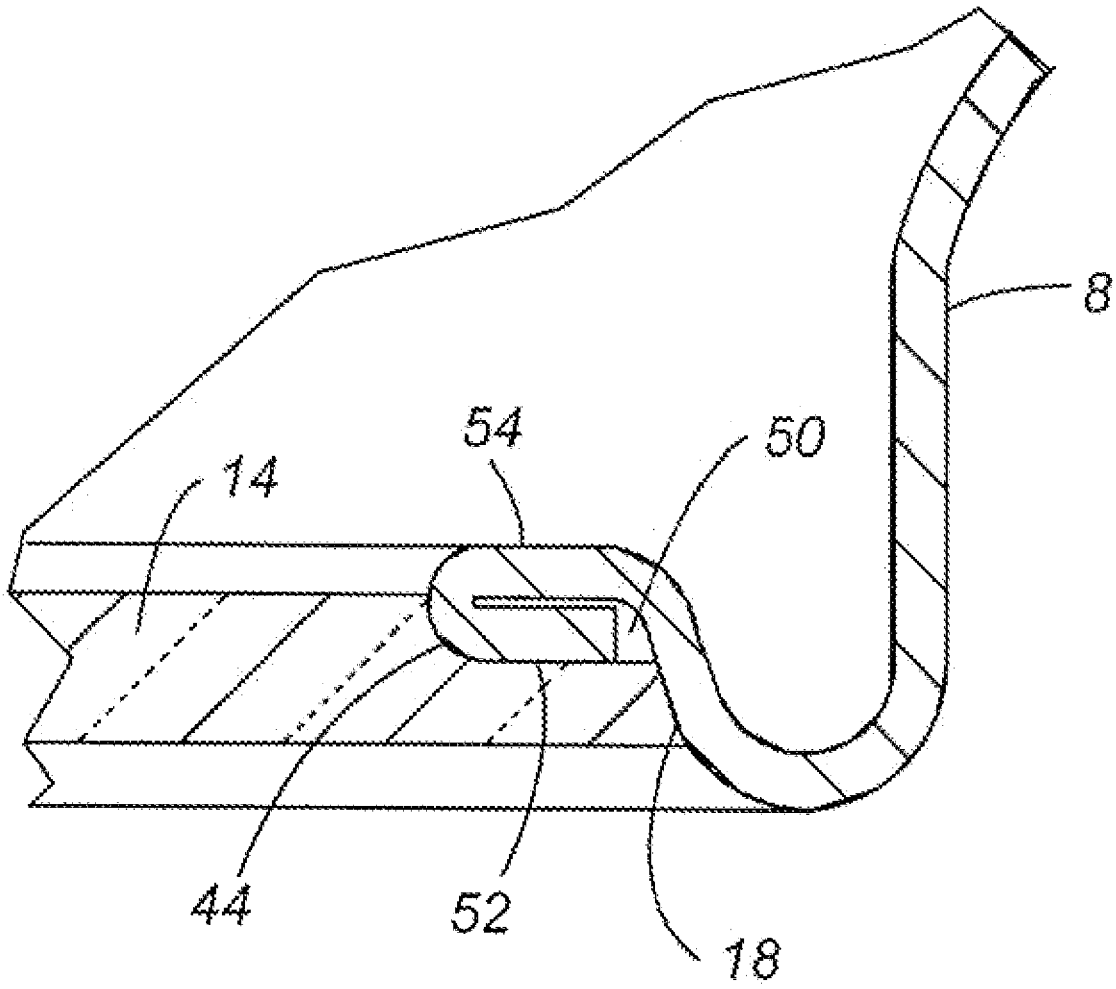
FIG. 17 is a partial cross-sectional front elevation view of a lower portion of a metal microwavable bowl, and identifying an alternative embodiment.

Referring now to FIG. 17, a slight variation of the present invention is provided wherein the container sidewall 8 is interconnected directly to the microwave transparent material 14. This configuration is similar to that shown in FIGS. 15 & 16, although the microwave transparent material here is also interconnected along the lower curved member of the container sidewall 8. In this embodiment, the container sidewall lower end 50 is once again isolated from exposure to oxygen by the positioning of the microwave transparent material 14. In FIG. 18, the container sidewall second end 50 is elevated above a lower most portion of the container, and the microwave transparent material 14 is interconnected to the container sidewall exterior edge 52 to prevent the container sidewall lower end 50 from being exposed to oxygen. The microwave transparent material peripheral edge 18 may be further interconnected to the container sidewall 8, as well as welded or otherwise interconnected to the container sidewall exterior edge 52.

Although each of the geometric configurations provided in FIGS. 1-17 have proven to be effective, numerous other variations may be provided as appreciated by one skilled in the art and which may be dictated by preferred geometric shapes, material costs, and/or manufacturing concerns.

While an effort has been made to describe various alternatives to the preferred embodiment, other alternatives will readily come to mind to those skilled in the art. Therefore, it should be understood that the invention may be embodied in other specific forms without departing from the spirit or central characteristics thereof. Present examples and embodiments, therefore, are to be considered in all respects as illustrative and not restrictive, and the invention is not intended to be limited to the details given herein.

What is claimed is:

1. A metallic ring adapted for interconnecting a sidewall of a microwaveable container to a microwave transparent material positioned on a lower portion of the microwaveable container, comprising:

an outer panel wall having a first end adapted for interconnection to the sidewall of the container;

an inner panel wall interconnected on a lower end to said outer panel wall to form a countersink;

an inwardly extending ledge interconnected to an upper end of said inner panel wall; and a second end of said metallic ring interconnected to said inwardly extending ledge and oriented outwardly toward said inner panel wall to form a fold in said inwardly extending ledge;

wherein the microwave transparent material is interconnected to a lower surface of the metallic ring between said fold and said second end; and wherein the microwave transparent material has a perimeter edge which is in contact with the inner panel wall of the metallic ring.

2. The metallic ring of claim 1, wherein said second end of said metallic ring is oriented substantially parallel to said inwardly extending ledge.

3. The metallic ring of claim 1, wherein said microwave transparent material is interconnected to said metallic ring with an ultrasonic weld.

4. The metallic ring of claim 1, wherein said second end of said metallic ring is substantially shielded from exposure to oxygen.

5. The metallic ring of claim 1, wherein at least a portion of said metallic ring is coated with a polypropylene material.

* * * * *